United States Patent [19]

Schönmeier et al.

[11] 4,368,855

[45] Jan. 18, 1983

[54] WEB-CUTTING APPARATUS

[75] Inventors: Herbert Schönmeier, Dusseldorf; Ewald G. Welp, Erkrath, both of Fed. Rep. of Germany

[73] Assignee: Jagenberg Werke AG, Dusseldorf, Fed. Rep. of Germany

[21] Appl. No.: 235,258

[22] Filed: Feb. 17, 1981

[30] Foreign Application Priority Data

Feb. 14, 1980 [DE] Fed. Rep. of Germany ..... 3005426

[51] Int. Cl.[3] ..... B65H 19/20; B65H 17/08

[52] U.S. Cl. ..... 242/56 R; 242/66

[58] Field of Search ..... 242/56 R, 66

[56] References Cited

U.S. PATENT DOCUMENTS

| | | | |
|---|---|---|---|
| 2,682,379 | 6/1954 | Piper | 242/56 R |
| 3,049,311 | 8/1962 | Birch | 242/66 X |
| 3,167,268 | 1/1965 | Birch | 242/56 R |
| 3,910,517 | 10/1975 | Harrison | 242/56 R |
| 3,918,659 | 11/1975 | Okubo | 242/66 |
| 4,304,368 | 12/1981 | Bartmann | 242/66 |

*Primary Examiner*—Edward J. McCarthy

*Attorney, Agent, or Firm*—Sprung, Horn, Kramer & Woods

[57] ABSTRACT

In a web winding apparatus comprising a pair of spaced support rolls for a core tube to be placed thereon, means for driving at least one of said rolls, means for delivering a web to a core tube supported on said rolls, and means for cutting the web when it is desired to replace the core tube, the improvement wherein said cutting means comprises an elongated blade extending longitudinally of the rolls, and means for advancing and retracting said blade in the space between said rolls so as to contact and cut said web in advanced position and to withdraw said web into standby position between cuttings. The blade can be caused to move in a straight line or an arcuate path between active and inactive positions and guide means may be provided to prevent skewing.

8 Claims, 5 Drawing Figures

WEB-CUTTING APPARATUS

BACKGROUND OF THE INVENTION

The invention relates to a cutting apparatus for webs wound onto core tubes on a pair of support rolls driven in rotation.

In the shaftless winding of webs of paper, fabrics or plastics into rolls, a core tube is inserted into the wedge between two rotatable support rolls which are spaced from each other and whose axes are parallel to each other, and at least one of which is driven. The head end of the web is fastened to the circumference of the core tube, which is then caused to rotate by the pair of support rolls, the web thus being wound onto the core tube. The completely wound web roll is lifted off the pair of support rolls or pushed out of the way. Before or during this operation, the web is cut. The new web head end so formed is attached to a new core tube.

The web is difficult to cut because of the narrow gap between the support rolls and the resultant poor accessibility. Up to now this operation has been performed either before the ejection of the wound roll, by cutting its top winding by means of a wedge as with a letter opener, or, in the case of hard-to-tear materials, by first ejecting the roll and then cutting the stretched web in proximity to the first support roll. Since at the start of the winding operation the wedge between the support rolls is largely filled by the core tube, there is no room for a stationary cutting blade. Now if the efficiency of the winding machine is to be improved, it must be sought to effect the core-tube change as economically as possible, which means that the operations involved in said change, including the cutting of the web, must entail practically no loss of time and no waste of material.

SUMMARY OF THE INVENTION

The object of the present invention is to provide a web-cutting apparatus which is constructed and disposed in such a way that the web can be cut without loss of time and without waste of material as the finished web roll is lifted off and moved out of the way.

This object is accomplished through a web-cutting apparatus of the type mentioned above which has the characteristics set forth in the claims.

The advantage resulting from the use of the web-cutting apparatus in accordance with the invention is that at the start of the winding operation, when the wedge between the support rolls is largely occupied by the core tube and there is no room for a cutting blade, the cutting blade is in a retracted stand-by position, whereas when because of the increasing diameter of the roll being wound more room becomes available in the wedge between the support rolls the cutting blade is advanced into that wedge, where on completion of the winding operation it can be deployed at once to cut the web as the finished roll is lifted off and moved out of the way. The web-cutting apparatus in accordance with the invention is equipped with driving and guiding means assuring that the cutting blade is moved into its operating position in perfect alignment to make a straight cut across the web.

BRIEF DESCRIPTION OF THE DRAWINGS

The invention will now be described in greater detail with reference to an embodiment illustrated in the accompanying drawings, wherein.

DETAILED DESCRIPTION OF THE INVENTION

Figure 1:
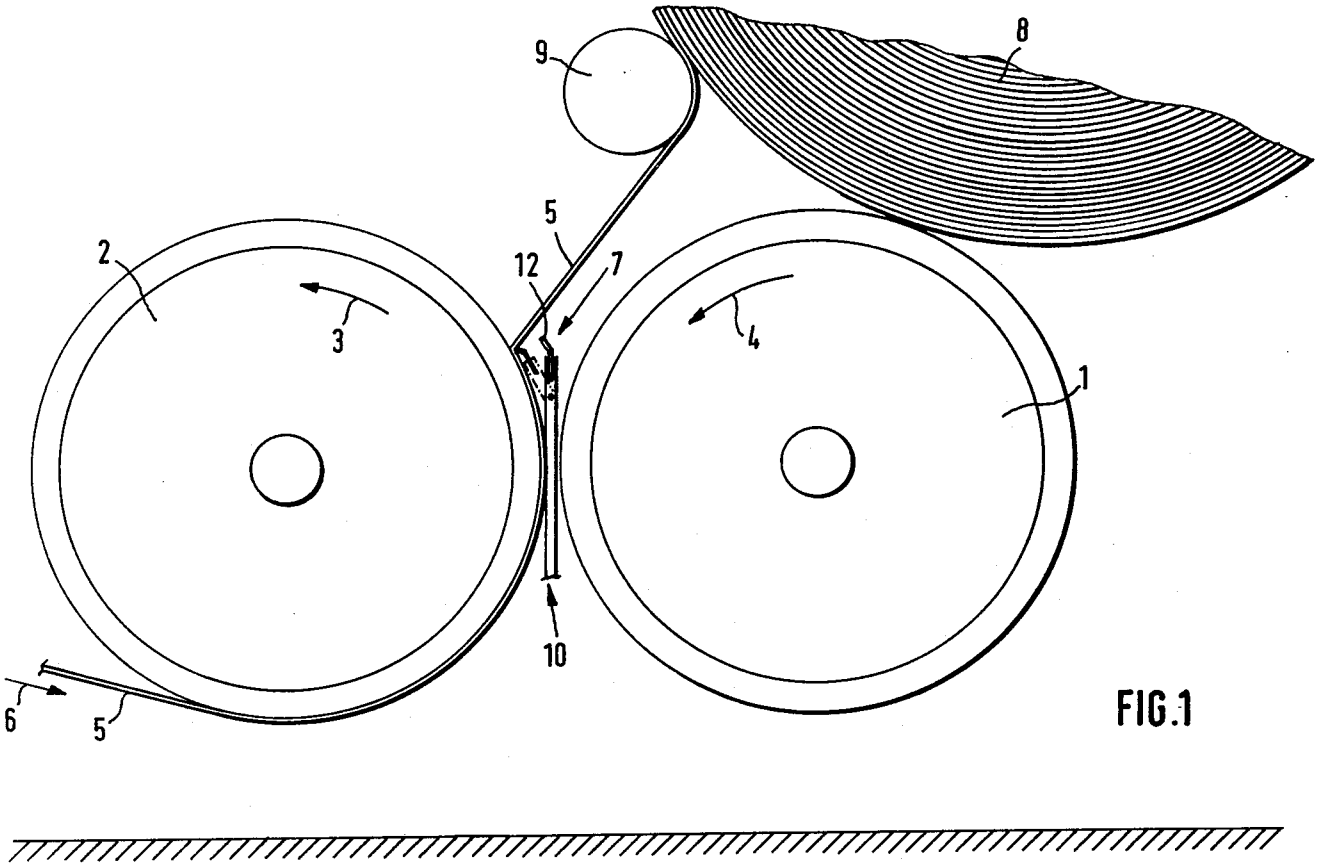
FIG. 1 is a diagrammatic side elevation of the winding machine.

The winding machine comprises two support rolls 1 and 2 which are spaced from each other, with their axes parallel, and which in winding revolve in the direction indicated by the arrows 3 and 4, at least one of said rolls being driven in rotation. Partly wrapped around support roll 2 is a web 5 which is led in the direction of the arrow 6 into the wedge 7 between the support rolls 1 and 2 and there is wound into a roll 8.

The web-cutting apparatus in accordance with the invention comprises a blade holder 10 which extends in the axial direction of the support rolls 1 and 2 and is formed of a carrying part, namely, a guide-rod system 16, and a tiltable part. Mounted on the latter is a cutting blade 12, which preferably is provided with a serrated cutting edge 13.

For the movement of the blade holder 10 through the gap between the support rolls 1 and 2, a drive 14 is provided which consists of two pneumatic or hydraulic cylinder/piston units whose piston rods 15 are articulated to the guide-rod system 16. For the pivoting movement of the tiltable part with the cutting blade 13, a drive 17 is disposed on the guide-rod system 16.

Straight-line guidance of the blade holder 10 is provided by a guide 18, formed by rails, which is engaged by guide members 19 disposed on the guide-rod system 16.

To prevent skewing as the blade holder 10 is moved, two pinions 21 are provided, both of which are seated on a parallel shaft 22 and mesh with racks 20 mounted on frames (not shown) located on either side of the apparatus. The shaft 22 is secured to the blade holder 10.

In the position shown in FIG. 1, the completely wound roll 8 is removed from the support rolls 1 and 2 by means of an ejector roll 9. At that instant, the cutting blade 12 introduced between the support rolls 1 and 2 into the wedge 7 for the purpose of cutting the web is pivoted into the operating position indicated by dash-dotted lines and bears by its cutting edge 13 on the web 5 which hugs the circumference of the support roll 2. As the wound roll 8 is moved out of the way while the support rolls 1 and 2 are motionless, the web 5 is torn off along the cutting edge 13 of the cutting blade 12. This tearing-off action is facilitated when the cutting edge 13 of the cutting blade 12 is serrated.

After the wound roll 8 has been removed, the blade holder 10 is retracted into its stand-by position (FIG. 3) while the new web head end is held to the support roll 2 by vacuum, for example. A core tube 11 is then inserted into the wedge 7 between the support rolls 1 and 2, the head end of the web is fastened to the circumference of said tube, and winding of the web onto the tube is continued through rotation of the support rolls 1 and 2 in the direction of the arrows 3 and 4.

Figure 2:
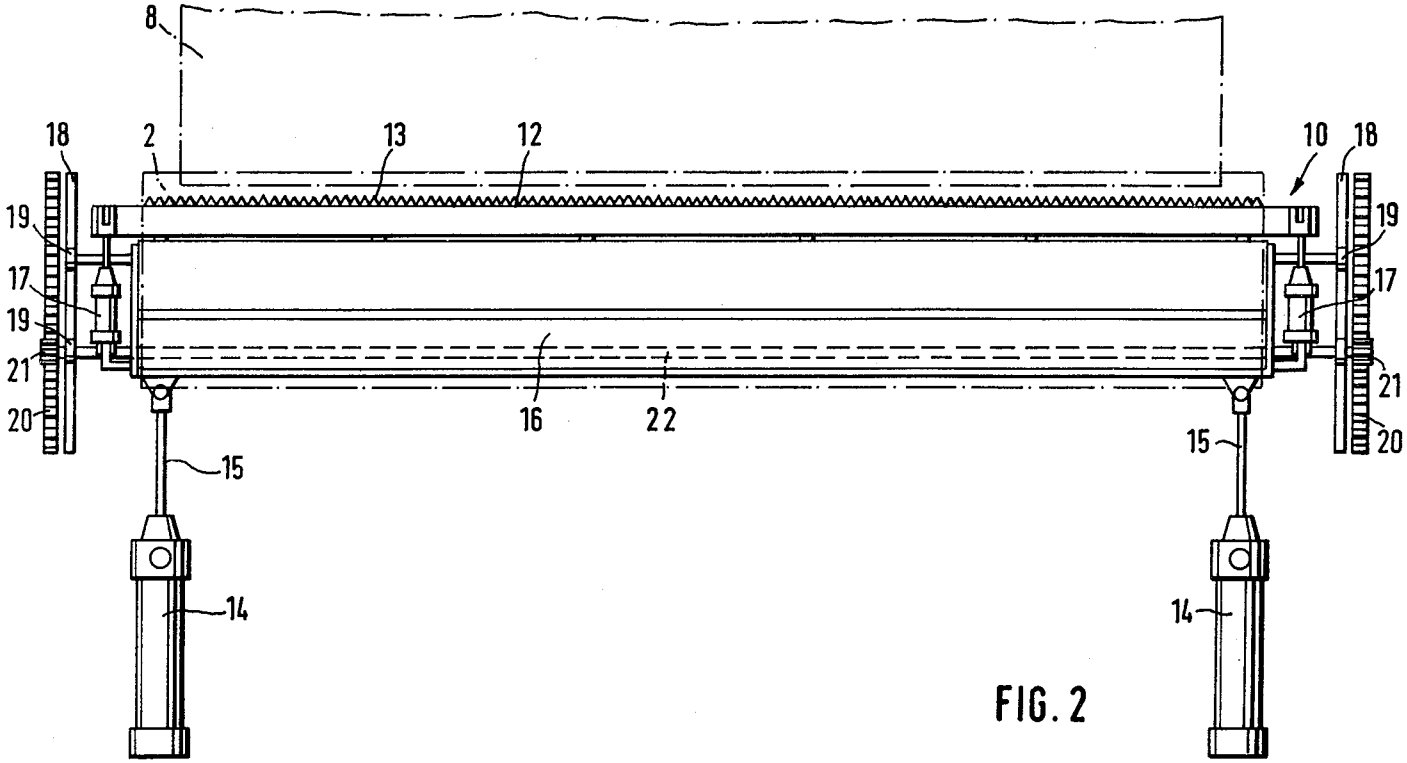
FIG. 2 is a front elevation of the web-cutting apparatus in accordance with the invention.
Figure 4:
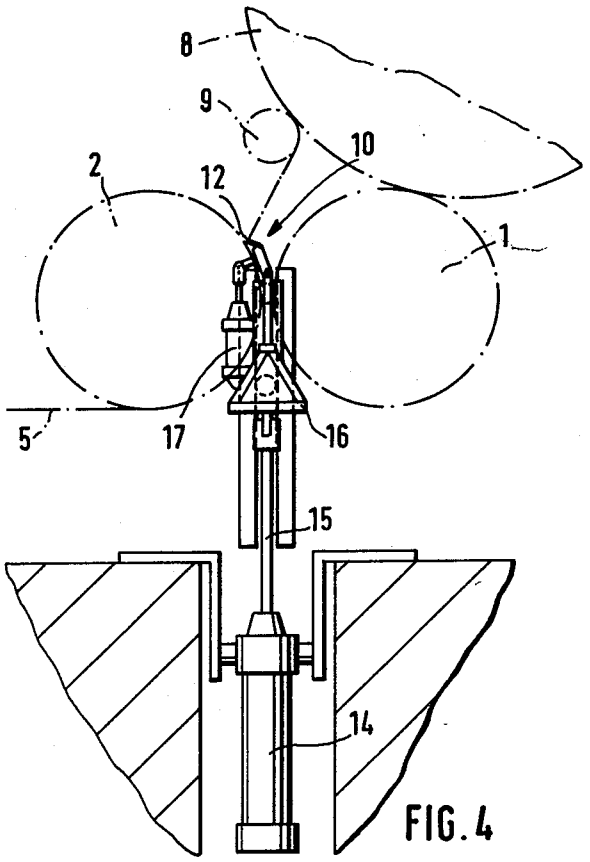
FIG. 4 is a similar view showing the web-cutting apparatus in its operating position.
Figure 3:
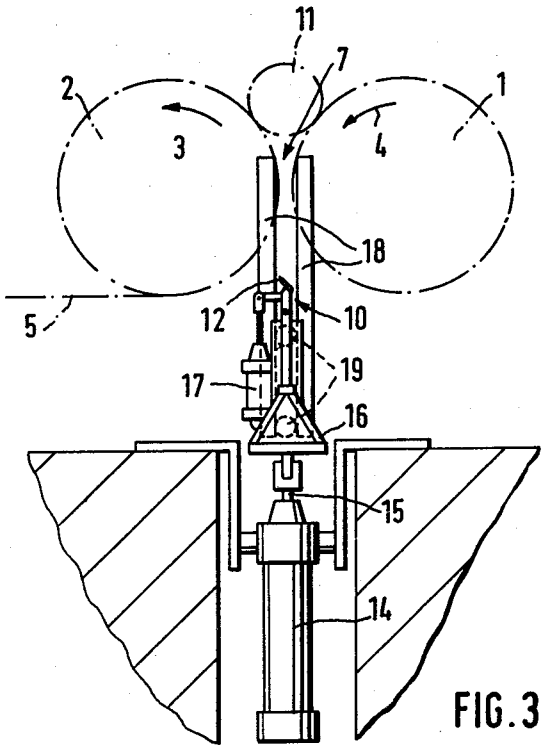
FIG. 3 is a side view of the web-cutting apparatus in its retracted stand-by position.

FIGS. 2 to 4 show the overall arrangement of web-cutting apparatus, including driving and guiding means.

For the up-and-down movement of the cutting blade 12, there is provided a drive 14 consisting of two pneumatic or hydraulic cylinder/piston units whose piston rods 15 are articulated to a guide-rod system 16 to which the blade holder 10 is pivotably secured. For actuation of the pivoting movement of the cutting blade 12, a drive 17 is mounted on the guide-rod system 16.

Vertical guidance of the cutting blade 12 is provided by a guide 18, formed by rails, which is engaged by guide members 19 disposed on the guide-rod system 16.

To assure uniform raising and lowering of the cutting blade 12, racks 20 with which pinions 21 joined to the guide-rod system 16 mesh are provided.

Figure 5:
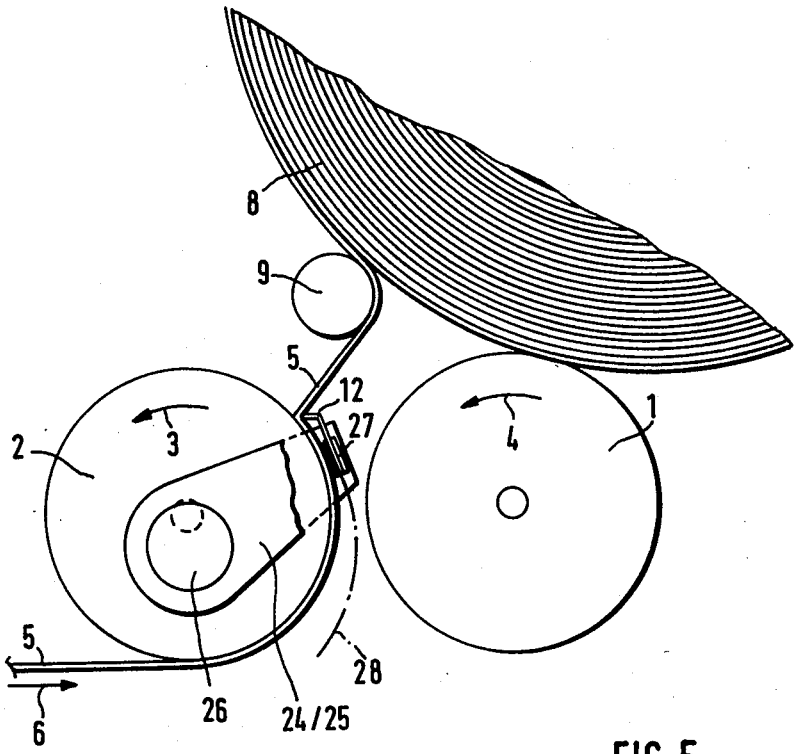
FIG. 5 shows a modification of the cutting-blade guide.

Shown in FIG. 5 is a modification of the cutting-blade guide. Here the cutting blade 12 is secured by means of a mount 27 between two levers 24 and 25. The latter may, for example, be adapted to pivot eccentrically about the shaft of the support roll 2 with the aid of known actuating means (not shown) whereby the cutting blade can be moved along an arcuate path 28 between the support rolls into the cutting position and retracted into the stand-by position. Since the levers 24 and 25 are eccentrically mounted, an enlarged trunnion 26 is provided about the support-roll trunnion.

It will be appreciated that the instant specification and claims are set forth by way of illustration and not of limitation, and that various changes and modifications may be made without departing from the spirit and scope of the present invention.

I claim:

1. In a web winding apparatus comprising a pair of spaced support rolls for a core tube to be placed thereon, means for delivering a web to a core tube supported on said rolls, and means for cutting the web when it is desired to replace the core tube, the improvement wherein said cutting means comprises an elongated blade extending longitudinally of the rolls, and means for moving said blade between advanced and retracted positions in the space between said rolls so as to contact for cutting said web in advanced position and to withdraw said blade into retracted position between cuttings, the blade advancing means includes means for tilting said blade when it arrives in advanced position.

2. An apparatus according to claim 1, wherein the blade advancing means causes said blade to move in a straight line between advanced and standby positions.

3. An apparatus according to claim 2, wherein said blade moves vertically between said support rolls.

4. An apparatus according to claim 1, wherein the blade advancing means includes a pair of spaced guides operatively connected with the ends of said blade.

5. An apparatus according to claim 4, wherein said spaced guides each includes a pinion and a rack engaged by said pinion, said advancing means including a shaft parallel to said rolls and connected with said blade, said shaft at its ends carrying said pinions.

6. An apparatus according to claim 1, wherein said blade has a serrated edge.

7. An apparatus according to claim 1, wherein the blade advancing means causes said blade to move along an arcuate path between advanced and standby position.

8. An apparatus according to claim 7, wherein said blade advancing means includes a pair of spaced levers, one end of each lever being respectively connected with one end of said blade, the other end of each lever being mounted for rotation about an axis parallel to the rolls, and means for pivoting said levers about said axis so as to move said blade along said arcuate path.

* * * * *